United States Patent [19]

Vincent

[11] Patent Number: 4,602,801

[45] Date of Patent: Jul. 29, 1986

[54] ROLLER SKATE

[76] Inventor: Yvon M. Vincent, 1, Avenue des Bosquets, 91800 Brunoy, France

[21] Appl. No.: 570,306

[22] Filed: Jan. 13, 1984

[30] Foreign Application Priority Data

Jan. 14, 1983 [FR] France ..... 83 00555
Dec. 30, 1983 [FR] France ..... 83 21086

[51] Int. Cl.[4] ..... A63C 17/12

[52] U.S. Cl. ..... 280/11.115; 280/11.2; 280/251

[58] Field of Search ..... 280/11.115, 11.2, 11.21, 280/221, 251, 255

[56] References Cited

U.S. PATENT DOCUMENTS

| | | | |
|---|---|---|---|
| 903,525 | 11/1908 | Wellnitz | 280/11.115 |
| 968,517 | 8/1910 | Pierman | 280/11.115 |
| 1,070,168 | 8/1913 | Nordling | 280/11.115 |
| 1,437,314 | 11/1922 | Jorgensen | 280/11.115 |
| 2,536,569 | 2/1951 | Purkey | 280/221 |
| 4,394,028 | 7/1983 | Wheelwright | 280/11.2 |
| 4,417,737 | 11/1983 | Suroff | 280/11.2 |

FOREIGN PATENT DOCUMENTS

| | | | |
|---|---|---|---|
| 332471 | 1/1921 | Fed. Rep. of Germany | 280/11.115 |
| 2726961 | 1/1979 | Fed. Rep. of Germany | 280/11.2 |
| 54250 | 4/1904 | France | 280/11.115 |
| 523987 | 4/1955 | Italy | 280/11.115 |

*Primary Examiner*—John J. Love
*Assistant Examiner*—M. Dukes
*Attorney, Agent, or Firm*—Laurence R. Brown

[57] ABSTRACT

A roller skate in which the automatic action of normal walking produces a driving action on the wheels. A heel kick to the pedal of the skate causes the putting in operative position of a control device. During the lifting of the skate, the control device comes back to a standby position. A toe kick to the pedal after the waiting position causes the putting in braking position of the control device. The braking is controlled by the depression of the pedal and is progressive. The control device is locked in the position selected and a new position requires the reversion to the standby position.

8 Claims, 10 Drawing Figures

ROLLER SKATE

TECHNICAL FIELD

The invention relates to a roller skate.

BACKGROUND OF THE INVENTION

Although the use of roller skates permits high speeds of movement to be attained, it possesses a certain sporting character which, due to the inevitable risks, generally restricts it to young or long-practiced persons.

The risks mentioned are obviously associated with stopping difficulties. It has in fact been considered to equip the front part of conventional roller skates with an elastic element which the skater can bring into contact with the ground by applying a thrust with the toe of his foot to the front of the skate. This is obviously a highly rudimentary braking means, which may even prove dangerous if the rolling of the skate is interrupted violently by contact between the said elastic element and a part protruding on the ground. Although it does not appear impossible to devise less random braking devices, particularly having a progressive action, it should be pointed out that the repeated application of brakes of this type by an inexperienced or timid skater would compel him to renew his starting effort each time, which would make travelling with such roller skates very tiring.

A chief object of this invention is to permit the construction of a roller skate which, on the one hand, presents the possibility of progressive braking which is perfectly safe in all circumstances, and which, on the other hand, is arranged so as to permit the skater to exert a driving action with his foot upon at least one of the rollers of the skate with which he is equipped, these two possibilities combining to remove any sporting character from the use of the roller skates according to the invention, which thus becomes accessible even to elderly persons after extremely short training.

BRIEF SUMMARY OF THE INVENTION

The roller skate according to an embodiment of the invention comprises a roller chassis, upon which a pedal, adapted to support the foot, is mounted pivotably about at least one transverse axis, between the standby position and an operative position, reached each time the skater applies a thrust with his heel to the rear of the pedal in the standby position, a braking device which is mounted on the chassis so as to be operated each time the skater applies a thrust with the toe of his foot to the front of the pedal in the standby position, a transmission device which is mounted on the chassis so as to be operated each time the skater applies a downward thrust with his foot to the pedal, transferring it from its operative position into a depressed position and which is coupled to at least one of the rollers, so as to exert a driving action upon it at each operation of the pedal, and elastic means, such as springs, to return the pedal from its depressed position into its standby position when the skater raises his foot.

The safety in use of the roller skate according to the invention obviously results from the fact that, in the standby position of the pedal, the skater can at any moment brake his progress by giving "a toe kick" to said pedal, whereafter, having obtained the desired reduced speed or stoppage, the skater can continue or resume his movement by first applying a "heel kick" to the pedal of the skate, then depressing the pedal by the effect of his weight. When the pedal reaches its position of maximum depression, the skater can then raise his foot equipped with the skate above the ground, for which purpose he presses on his other foot, which incidentally may or may not be equipped with a roller skate according to the invention—or even optionally a conventional roller skate. As soon as the first skate has ceased to be applied to the ground, the elastic means with which it is provided brings its pedal from its depressed position into its standby position, and the skater can once more place the first skate on the ground, then brake in case of need.

It is in fact preferable, although not obligatory, for both the skater's feet to be equipped with roller skates according to the invention, because the use of such a pair of skates can then differ greatly from that of a pair of conventional skates, and particularly employ only the automatic actions of normal walking, which is doubly favorable as it reduces, on the one hand, the period for learning to skate, and on the other hand, the risks run by the user. Indeed, if after having operated, for example, the pedal of his right skate as previously described, whilst his left foot, likewise equipped with a skate according to the invention, is raised above the ground in a normal walking movement, as soon as the skater has rested his left skate on the ground he can raise his right foot and thus permit the return of the corresponding pedal into the standby position, whilst his left foot drives the corresponding skate through the intermediary of its driving roller or rollers operated by the corresponding pedal. Obviously at each "step", the skater travels a distance which is greater than the customary length of his pace by the distance which the driving roller of the corresponding skate has rolled.

In a preferred embodiment of the roller skate according to the invention, a freewheel device is inserted between the transmission device and each driving roller to which it is coupled.

This embodiment is particularly advantageous inasmuch as it permits an additional lengthening of each "step" of the skater, by virtue of the free rolling of the skate after its pedal has reached the position of maximum depression; obviously, in case of danger the skater will be able to interrupt this free rolling movement on one foot immediately by placing the other foot on the ground and by braking the corresponding skate, when the other skate may without disadvantage be raised above the ground, or else remain in contact therewith.

In a particular embodiment of the invention, the rear part of the pedal of the roller skate is connected to the chassis by means of a link rod, articulated at both its ends so as to pivot freely in a vertical longitudinal plane between two positions, one front and the other rear, which correspond respectively to the standby position and to the operative position of the pedal; on the other hand, two elastically deformable elements such as springs are provided, the first to return the link rod from its rear position to its front position, and the second to return the pedal from its depressed position to its operative or standby position.

The functioning of this embodiment of the invention is particularly safe inasmuch as each heel kick by the skater, which pivots the articulated link rod to the rear, certainly moves the front of the pedal away from the braking device, so that the driving operation of the pedal can occur without any risk of simultaneous operation of the braking device.

According to another advantageous feature of this mbodiment of the invention, the first spring may enage the transmission device so that, after having been ensioned by the pivoting of the link rod from front to ear, the expansion of said first spring, during the deression of the pedal, reinforces the driving action of ie latter.

This feature has the advantage of storing in some egree the force corresponding to the skater's heel kick i the tension of the first spring, this energy thus stored eing afterwards recuperated during the depression of ie pedal to reinforce its driving action.

Means are preferably provided to fix the pedal of the oller skate according to the invention detachably to the ont part only of the skater's foot, his heel remaining ee to rise. This arrangement facilitates the use of skates ccording to the invention in "normal walking", as xplained previously: indeed the skater can thus, at the nd of each step, raise his heel above the skate before aising and moving forward the corresponding foot and kate.

According to another feature, which is optional but dvantageous, of the roller skate according to the inention, the driving roller or rollers, of relatively large iameter is or are mounted in the median part of the hassis, the front and rear parts of which each carry at east one idler roller, of equal or different diameter. On ie other hand, the two planes tangent to a driving oller and, respectively, to a front roller or to a rear oller, preferably make between them an obtuse angle, iffering only by a few degrees or by a few tens of egrees from 180°.

In the case of this embodiment, each heel kick by the kater applies the rear roller to the ground, which faors the movement of the pedal of the skate from its andby position to its operative position. By contrast, ach depression of the pedal, or else when the latter is in s standby position, each toe kick given by the skater to ie front of the pedal, pivots the whole of the skate bout the driving roller or rollers, so that the front oller or rollers are applied to the ground, the rear roller r rollers being raised above the ground.

BRIEF DESCRIPTION OF THE DRAWINGS

Two embodiments of a roller skate according to the ivention are described below by way of example and lustrated diagrammatically in the accompanying rawing.

DETAILED DESCRIPTION OF THE INVENTION

Figure 1:
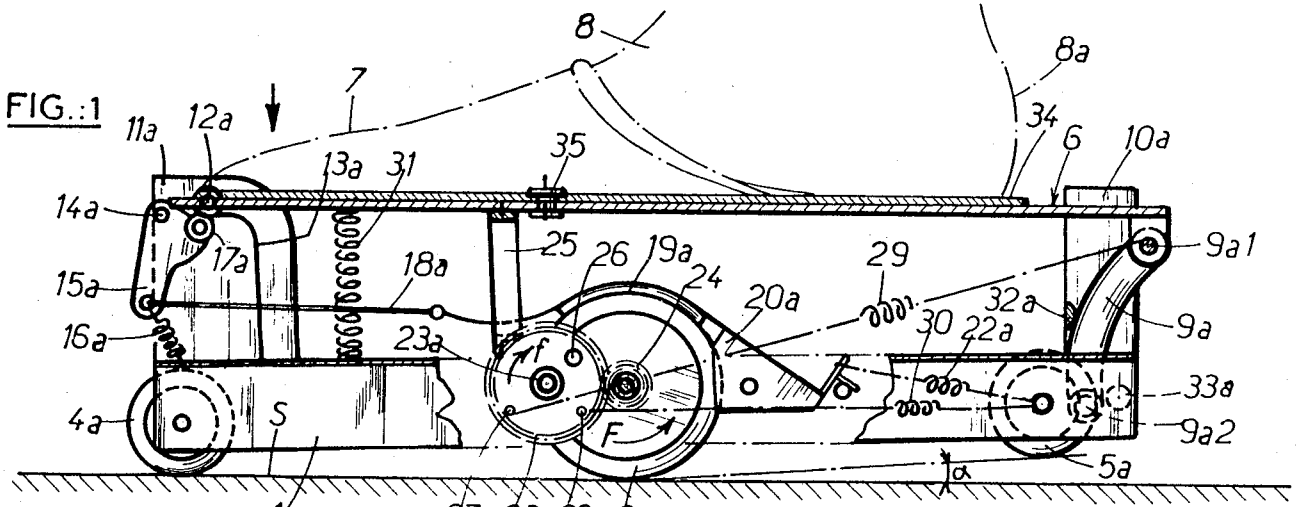
FIGS. 1 to 3 are partial sectional views through the ertical longitudinal plane of symmetry of the skate in ie first embodiment; they show its pedal respectively i its braking position, in its operative position and in its epressed position.

In the FIGS. 1–4 representing a first embodiment of the invention, 1 designates the chassis of the roller skate, which may be constructed in various ways, for example in the form of an elongate beam, of small height and small width, but sufficiently strong to support the skater's weight. Two driving rollers 2*a* and 2*b*, several centimeters in diameter, are mounted on the median part of the elongate chassis 1, on each side thereof; for example, an axis 3, to the ends of which two rollers 2*a* and 2*b* are keyed, passes through a transverse bearing (not shown) mounted in the chassis 1. Two idler rollers 4*a* and 4*b* are carried by the front part of the chassis 1, and two other idler rollers 5*a* and 5*b* by its rear part. In a preferred embodiment, the pairs of rollers 2*a*–2*b*, 4*a*–4*b* and 5*a*–5*b* are arranged so that the two planes inferiorly tangent to the median rollers 2*a*–2*b* and, respectively to the front rollers 4*a*–4*b* or to the rear rollers 5*a*–5*b*, form between them an obtuse angle, the difference from 180° of which, designated $\alpha$ in FIG. 1, has a value of a few degrees, or at most of a few tens of degrees. By virtue of this arrangement, it is clear that the chassis 1 of the skate can rest upon the ground, designated S, either by its two pairs of rollers 2*a*–2*b* and 4*a*–4*b*, or by its two pairs of rollers 2*a*–2*b* and 5*a*–5*b*, as will be described in further detail below.

A pedal 6 is mounted above the chassis 1; in the embodiment illustrated, it consists essentially of a substantially rectangular plate, for example metallic, the dimensions of which are slightly greater than required by the shoe size of the skaters for whom the relevant skate is intended. The detachable fixing elements for the skater's foot are arranged on the front part of the pedal 6; in the embodiment illustrated, these consist of a kind of mule or toe-clip 7, which retains only the front part of the skater's foot 8, the heel 8*a* of which is, on the contrary, left free to rise.

Figure 4:
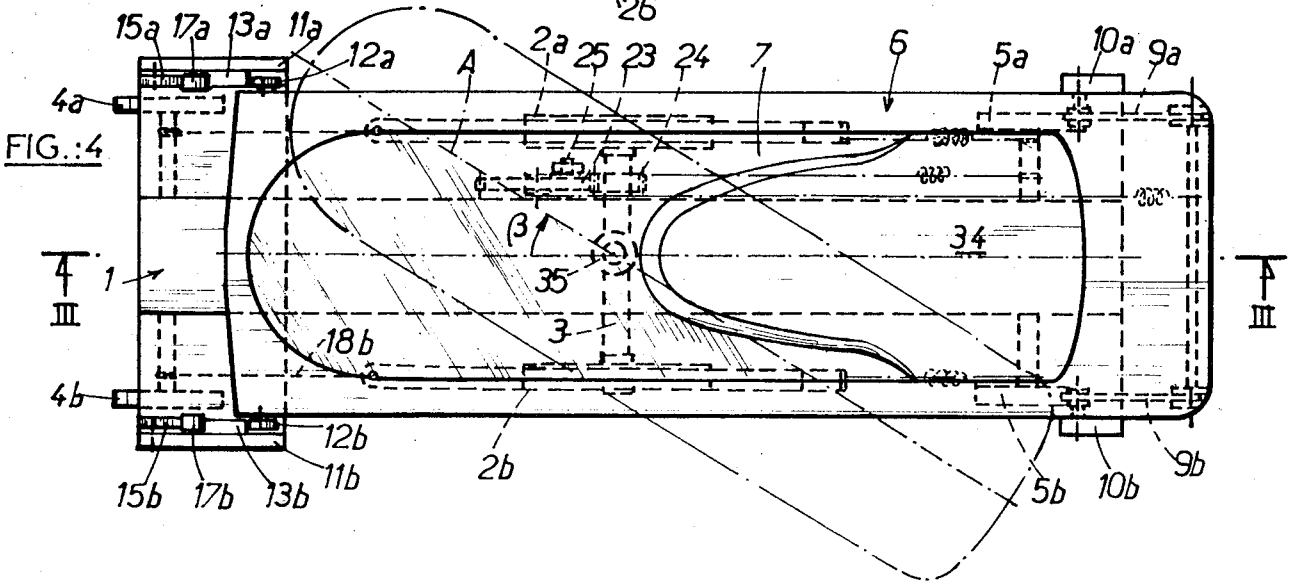
FIG. 4 is a plan view corresponding to FIG. 3.

On the other hand, the rear part of the pedal 6 is connected to the corresponding part of the chassis 1 by two link rods 9*a* and 9*b*, each of which has its ends articulated, the one 9*a*1 (FIG. 1), beneath the rear of the pedal 6, and the other 9*a*2, on the rear of the chassis 1, so that said link rods 9*a* and 9*b* can pivot freely, each in a vertical longitudinal plane parallel to the vertical plane of symmetry of the skate (designated III—III in FIG. 4).

During the pivotal movements of the link rods 9*a* and 9*b* in the vertical planes previously mentioned, and the corresponding movements of the pedal 6, the rear of the latter is guided by the vertical members 10*a* and 10*b* of a yoke, the median part of which is attached to the rear of the beam forming the chassis 1, whereas the front of the pedal 6 is guided by the vertical members, 11*a* and 11*b*, of another yoke, the median part of which is attached to the front of the chassis 1. Whereas the lateral edges of the pedal 6 slide with slight friction in contact with the internal faces of the members 10*a* and 10*b*, the same edges are guided, in front of the pedal 6, by wheels 12*a* and 12*b* mounted idly on the edges of the pedal 6 and each rolling against a cam 13*a* or 13*b* which is fixed, for example, to the internal face of the corresponding member 11*a* or 11*b*, and the shape and function of which will be described in further detail below. It will be seen, particularly in FIGS. 1 to 3, that the dimensions of each cam, such as 13*a*, in the upward direction and in the rearward direction, are respectively smaller than the corresponding dimensions of the member 11*a*, so that the corresponding wheel 12*a* can be guided in a semi-groove, as shown in FIG. 4. To reduce further the friction between each of the wheels 12*a* and 12*b* on the other hand, and the surface of the corresponding member with which it comes into contact, quasi-spherical or hemispherical wheels may be employed.

Figure 2:
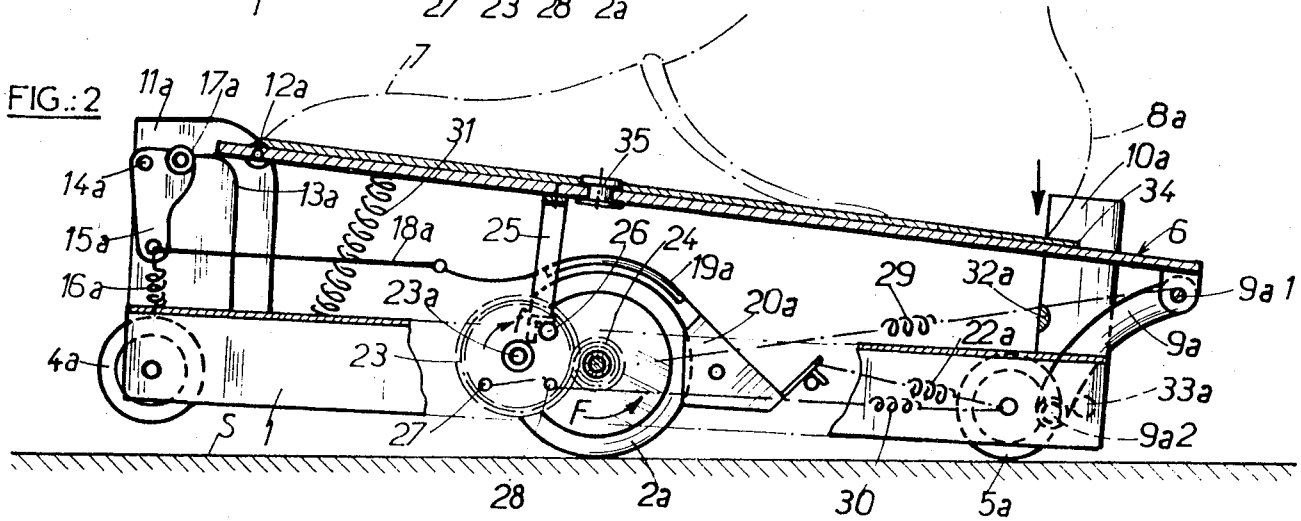
Figure 3:
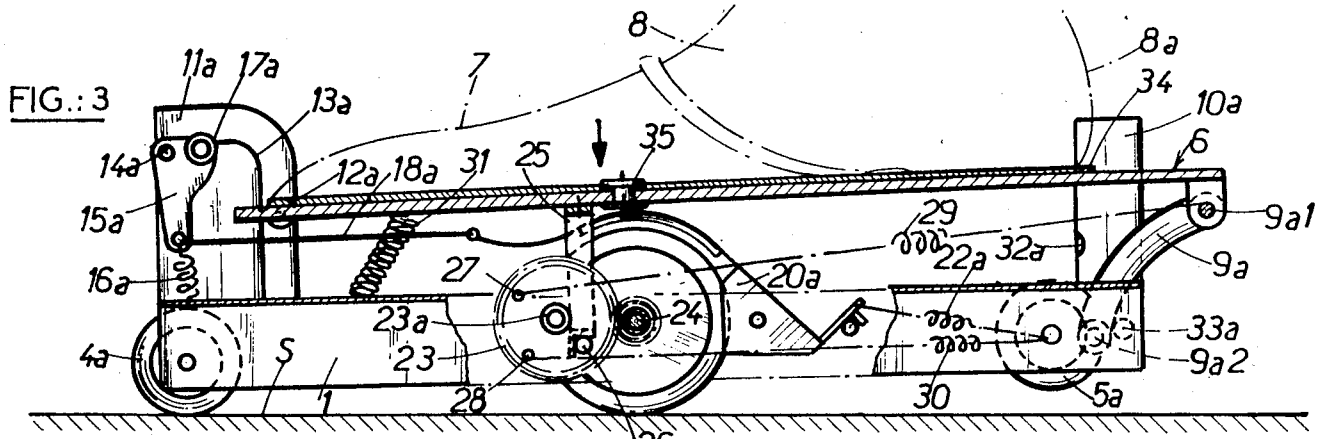

Each of the members 11*a* and 11*b* has articulated to it near its top front corner (at 14*a* in FIG. 1) a lever 15*a* or 15*b*, the lower arm of which is returned downwards by a spring such as 16*a*, hooked to the chassis 1, whereas its other arm carries an idler wheel, 17*a* or 17*b*, which, in the position of equilibrium of the lever 15*a*, under the action of the spring 16*a*, projects above the top edge of the cam 13*a*, as shown in FIGS. 2 and 3. When, on the other hand, the pedal 6 occupies the position illustrated in FIG. 1, and the skater exerts a downward thrust with the toe of his foot upon the front of the said pedal 6, each of the guide wheels 12*a* and 12*b* mounted idly at the front of said pedal 6 repels the corresponding wheel 17*a* or 17*b* downwards, pivoting the corresponding lever 15*a* or 15*b* clockwise counter to the force of the spring 16*a* or 16*b*. The lower arm of each lever, such as 15*a*, then exerts a traction directed forwards, upon a control cable 18*a* to tighten a brake jaw 19*a*, which is mounted above the median roller 2*a*; in the embodiment illustrated, the brake jaw 19*a* associated with each of the median rollers, such as 2*a*, is carried by a piece 20*a* which is mounted pivotably at 21*a* on the chassis 1 and which is returned into a position in which the brake jaw 19*a* is separated from the corresponding roller 2*a*, as shown in FIGS. 2 and 3, by a spring 22*a* stretched between the pivoting piece 20*a* and a point of the chassis 1, for example near the axis of the rear rollers 5*a* and 5*b*. When, as will be described below, the wheels 12*a* and 12*b* mounted idly at the front of the pedal 6 are withdrawn relative to the wheels 17*a* and 17*b* carried by the levers 15*a* and 15*b*, as shown in FIGS. 2 and 3, the springs such as 16*a* bring the levers 15*a* and 15*b* and the wheels 17*a* and 17*b* into the rest positions shown in FIGS. 2 and 3, whereas the springs such as 22*a* effect the release of the brake jaws such as 19*a*.

The gear 23 which could be replaced by a toothed segment of appropriate angle has its axis 23*a* mounted for free rotation in a bearing (not shown) carried by the chassis 1. The gear 23, the diameter of which must be considerably smaller than that of the median rollers 2*a* and 2*b*, in order to prevent it from striking parts protruding on the ground, meshes with a pinion 24, which is keyed on the axis 3 of the median rollers 2*a*, 2*b* with interposition of a freewheel device, for example a ratchet wheel, cooperating with a pawl; since freewheel devices of this type are well known, it is unnecessary to describe it in detail, and also the scale of the various figures did not permit it to be illustrated. It is sufficient to specify that this freewheel device is constructed so as to permit the free rolling of the median rollers 2*a* and 2*b* at speeds of rotation greater than the instantaneous speed of rotation communicated to it by the pinion 24, in mesh with the gear 23. A push rod 25 is fixed transversely beneath the pedal 6, at the level of a pawl 26, itself fixed transversely to the gear 23, or to the equivalent toothed segment. On either side of the pawl 26, the gear 23 also carries two lugs 27 and 28, to which the first ends of two springs 29 and 30 are respectively hooked, the second end of the spring 29 is hooked to a transverse axis joining the upper articulations of the link rods 9*a* and 9*b*; the second end of the spring 30 is fixed to the chassis 1, for example near the axis of the rear rollers 5*a* and 5*b*. The function of the two springs 29 and 30 will be explained later. Lastly, a spring 31 is interposed between the chassis 1 and an appropriate point of the lower face of the pedal 6, this point being located between the push rod 25 and the guide wheels 12*a* and 12*b*.

The mode of using the roller skate which has just been described is as follows:

When the skater engages his foot 8 in the mule 7, the weight of his body, if his other foot is raised above the ground, or only half the weight of his body if his other foot is placed on the ground, directly or with interposition of a roller skate, is supported, through the intermediary of the panel 6, by the link rods such as 9*a*, which the spring 29 draws into their extreme front position, defined by a stop, such as 32*a*, fixed to the internal face of the member 10*a* of the rear yoke, and by the powerful spring 31 bearing against the chassis 1. The pedal 6, on which skater's foot rests, then occupies its "standby position", which is practically horizontal, and which differs from that shown in FIG. 1 only in that the guide wheels 12*a* and 12*b* are raised above the wheels 17*a* and 17*b* of the braking control levers 15*a* and 15*b*, so that the brakes 19*a* and 19*b* are released. In this position, the push rod 25 is located in front of and above the transverse pawl 26 of the gear 23. Of course, in this standby position of the pedal 6, the skater can at any time brake the median rollers 2*a* and 2*b* by giving a toe kick to the front of the pedal 6, which has the effect of pivoting the levers 15*a* and 15*b* and of bringing the brake jaws 19*a* and 19*b* into contact with the rollers 2*a* and 2*b*.

In order to propel himself by the skate according to the invention, with which his right foot for example is equipped, the skater should then give a heel kick to the rear of the pedal 6, which was then in its standby position. This has the effect of pivoting the link rods 9*a* and 9*b* into their extreme rear position, defined by stops such as 33*a*, which may be realised for example by the ends of a rod, the median part of which is fixed to the rear of the chassis 1, and the length of which is adequate. The energy developed by the skater's heel kick is stored in the spring 29 which becomes tensioned, the gear 23 remaining in the rest position shown in FIGS. 1 and 2. The backward pivoting of the link rods 9*a* and 9*b* shifts in the same direction the pedal 6, the front wheels 12*a* and 12*b* of which are at first guided by the respective top edges of the cams 13*a* and 13*b*, then escape the latter when the said pedal 6 reaches its operative position, which is shown in FIG. 2, and in which the skater's weight is still at least partly balanced by the spring 31.

The skater then operates the pedal 6 with his foot so as to pivot it about the upper articulations 9*a*1 and 9*b*1 of the link rods 9*a* and 9*b*. During this depressing movement of the pedal 6, its front wheels 12*a* and 12*b* are guided respectively by the substantially vertical rear edges of the cams 13*a* and 13*b*, which reliably prevents any untimely operation of the control levers 15*a* and 15*b* of the braking devices. On the other hand there is compression of the spring 31, and the lower end of the push rod 25 which, in the operative position of FIG. 2 had been brought above the transverse pawl 26 of the gear 23, exerts a downward thrust upon the latter which has the effect of rotating said gear 23 in the direction of the arrow f (FIG. 2); this results in a rotation in the opposite direction F, of the median rollers 2*a* and 2*b*, on the axis 3 of which the pinion 24 is keyed. This rotation of the median rollers in the direction of the arrow F has the effect of advancing the whole of the skate and of the skater for a distance which obviously depends upon the depression stroke of the pedal 6 and upon the ratio of the transmission device 25-23-24. During the rotation of the gear 23, the point of attachment 27 of the spring 29 likewise moves in the direction of the arrow f, and when said point 27 has arrived above the axis 23*a*, said spring 29 can expand; thus the energy which has previously been stored in the spring 29 when the skater gave a heel kick, now reinforces the driving action of the pedal 6 upon the median rollers 2*a* and 2*b*.

FIG. 3 shows the pedal 6 in its position of maximum depression, which may be defined for example by bottom stops, not shown, and in which the pedal is once again substantially horizontal, the whole of the skate having pivoted about the driving rollers 2*a* and 2*b*, so that it is now the front rollers 4*a*, 4*b* which are in contact with the ground S. Since the push rod 25 ceases to exert a driving action upon the gear 23 and through the intermediary of the pinion 24, upon the median rollers 2*a* and 2*b*, the latter will roll freely when, during the seconds which follow, the skate and the skater continue to advance by inertia, that is to say due to the kinetic energy given them by the previous propulsion. At any moment during this free travel, but preferably just before it ends due to frictional phenomena, the skater, supporting himself on the ground with his left foot, raises his right foot and the skate with which it is equipped, so that the spring 30, by expanding, rotates the gear 23 in the direction counter to the arrow f; consequently the transverse pawl 26 of the gear 23 repels the push rod 25 and the pedal 6 upwards. In fact, since the pedal 6 is attached to the skater's foot, it is the chassis 1 and rollers which it carries which move downward. Through the intermediary of the spring 29, the same rotation of the gear 23 exerts a return force upon the link rods 9*a* and 9*b* into the extreme front position shown in FIG. 1; the front wheels 12*a* and 12*b* of the pedal 6 then return onto the upper part of the cams 13*a* and 13*b*, likewise by virtue of the expansion of the spring 31, so that said pedal 6 again occupies its standby position, and, when the skater rests his right foot on the ground, he is able to brake immediately, or at any subsequent moment, by giving a toe kick to the front of the pedal 6. In fact, as previously explained, although it is possible to use a single skate according to the invention, the skater's other foot being either equipped with an ordinary skate or without a skate, it is preferable to use two skates according to the invention simultaneously in the manner previously described, in order to utilise the automatic movements of normal walking whilst enjoying the important advantages associated, on the one hand, with the very considerable increase in the "length of steps", that is to say of the mean speed of progress, and on the other hand, the possibility of very rapid braking in all circumstances.

The invention is not limited to the embodiment previously described; it embraces all variants thereof, some of which will be indicated below by way of non-limiting examples.

As shown in FIGS. 1 to 4, a rigid tread 34, of a metallic material for example, may be interposed between the pedal 6 on the one hand, and the mule 7 and the heel 8*a* of the skater's foot on the other hand; this rigid tread 34, the dimensions of which are adapted to those of the skater's foot, is joined to the median part of the pedal 6 by a vertical pivoting axis 35, and locking means (not shown) are provided to lock the tread 34 on the pedal 6 in different positions, in which its longitudinal axis, designated A in FIG. 4, forms with the longitudinal axis (III—III in FIG. 4) an angle $\beta$, the value of which can be adjusted, preferably continuously, for example between 0 and $\pm 30$ degrees. It will be understood that this arrangement facilitates the use of the roller skates according to the invention by skaters whose feet are normally spaced at an angle of $2\beta$ when their heels are together. Obviously, the angle $\beta$ may be given a positive or negative value, to permit adaptation to skaters, the axes of whose two feet normally form a V with its apex turned either forwards or backwards.

The skate according to the embodiment may optionally be equipped with a single driving roller, for example 2*a*, the other median roller 2*b* being mounted idly. It is also possible to eliminate the second median roller 2*b* and arrange the chassis 1 so that the sole driving roller 2*a* is located substantially in the plane of symmetry (III—III in FIG. 4) of the skate. The total number of rollers of the skate according to the invention is a matter of choice, although it cannot be less than three. If it is provided with two median rollers, it may comprise only a single roller at the front and/or at the rear. In all cases, the angle $\alpha$ shown in FIG. 1 may have a zero value, so that all the rollers of the skate are always applied to the ground. The skate according to the invention may also not comprise median rollers, but only two rollers at the front or at the back, and at least one roller at the back or at the front, at least one of these rollers being driving.

The roller skate according to the embodiment, could, as a variant, be provided with means permitting the whole of the skater's foot 8, including its heel 8*a*, to be fixed to the pedal 6 or to the interposed tread 34.

The guide means for the pedal 6 between its different positions may be realised in various ways; particularly, the guidance of the rear part of the pedal 6 by the members 10*a*, 10*b* of the rear yoke is optional. This does not apply to the guidance of the front part of the pedal 6 by the members 11*a* and 11*b* of the front yoke; equivalent means could also be provided to guide laterally the median part of the pedal 6. In any case, these bilateral guide means could be replaced by monolateral guide means, optionally acting upon opposite sides of the pedal 6. The guide wheels 12*a* and 12*b* are optional and the cams 13*a* and 13*b* may have different shapes, or be replaced by equivalent means, to prevent the pedal 6 from operating the control levers 15*a* and 15*b* of the braking devices when it pases from its operative position of FIG. 2 into its depressed position of FIG. 3. These braking devices themselves and their control levers 15*a* and 15*b*, are also capable of widely varying construction, comprising for example shoe brakes of the type used on bicycles. Obviously, the number of the rollers of the brake according to the embodiment upon which the braking devices act is a matter of choice; it is theoretically sufficient to be able to brake a single roller irrespectively of its position relative to the elongate chassis 1; however, it is preferable to brake simultaneously at least two rollers located on either side of the chassis 1.

The push rod 25, fixed beneath the pedal 6, and the transverse pawl 26 fixed to the gear 23, or to the equivalent toothed segment, may be replaced by a link rod, the two ends of which are articulated about horizontal axes, the one beneath the pedal 6, and the other to a face of the gear or of the equivalent toothed segment, at a point close to that occupies by the pawl 26 in FIGS. 1 to 3.

Moreover, the transmission device, which consists in the embodiment illustrated in FIGS. 1 to 4 of the components 25, 26, 23 and 24, could be replaced by any other appropriate transmission device, of known type, this device preferably being arranged so that the depressing stroke of the pedal 6 is converted into a rotation of the driving rollers such as 2*a* and 2*b*, through the greatest possible angle, so that a single operation of the pedal 6 permits the skate and the skater to be given the highest possible speed. Whatever the embodiment chosen for this transmission device, it is always possible to have it engaged by the spring 29, so that after having been tensioned by the pivoting backwards of the link rods 9*a* and 9*b*, the expansion of said spring 29 during the depression of the pedal 6, reinforces the driving action of the latter.

The rear of the pedal 6 could be connected to the rear of the chassis 1 by a single link rod, similar to 9*a* and 9*b*, but arranged so as to pivot in the vertical plane of symmetry of the skate (designated III—III in FIG. 4).

The single compressed spring 31 could be replaced by a plurality of springs, particularly two similar lateral springs compressed respectively between the edges of the pedal 6 and the ends of a plate fixed transversely to the chassis 1.

All the springs previously mentioned, 16*a*, 16*b*, 22*a*, 22*b*, 29, 30, 31, or at least some of them, instead of consisting of helicoidal springs, could be formed by blade springs, or again by elastically deformable elements, of which a great number of known embodiments exist. Shock absorbers, of which a great number of known embodiments likewise exist, could optionally be associated with each of these springs or elasticaly deformable elements, or at least with some of them.

The shape and the construction of the chassis 1 are matters of choice. Instead of having its rear part supported by one or two link rods such as 9*a* and 9*b*, the pedal 6 could be mounted pivotably relative to the chassis 1 about one or two distinct transverse axes, through the intermediary of known mechanical elements.

In addition to the spring 29, an auxiliary spring could be stretched between an appropriate point on the chassis 1 and at least one of the link rods 9*a* and 9*b*, to contribute to returning the pedal 6 from its rear position to its standby position.

The control pawl 26 of the gear 23 may advantageously be replaced by an idler wheel.

The second embodiment of a skate according to the invention is illustrated, in side elevation and in section, in FIGS. 5 to 8. In these views, one of the lateral sides of the chassis 1 has been omitted to facilitate understanding of the figures. As in the embodiment according to the invention, the chassis consists of a U-shaped beam, through the wings of which, approximately at half their length, an axis 3 supporting the driving rollers 2*a* and 2*b* passes. Two idler rollers 32*a* and 32*b* are provided in the axis of the beam and at its ends. The position of the axes of the idler rollers is preferably provided so that only the driving rollers and one idler roller rest on the ground at the same time. This arrangement defines two support polygons, a rear polygon and a front polygon, corresponding to the points of application of the weight of the body during walking or running movements. Indeed, walking is effected by first placing the heel upon the ground; during this phase the weight of the body is transferred onto the heel. When it is desired to stop, it is the front part of the forward foot which supports the weight of the body and transmits it to the ground. In the skate according to the invention, the natural movements have been taken into consideration to control the operation of the skate or the braking by shifting, the weight of the foot into the front or rear support polygons. In order to take into consideration, in the standing rest position, the tendency to support the weight of the body on the soles of the feet, and in order to regain the distribution of the surfaces offered by the shoes, the axis of the driving rollers is shifted nearer to the rear roller than the front roller. This position facilitates maintaining the braking position of the skate and ensures stability at rest.

The transmission device (FIGS. 5–9) comprises a lever 33 articulated at one end to an axis 34 maintained in the chassis 1. The other end of the lever is equipped with an axis 35 carrying, at its center, an idler pulley 36 (FIG. 9) and at its ends, two wheels 37*a*, 37*b*. These two wheels move in rolling tracks 38*a*, 38*b* provided on the front longitudinal edges of the pedal 6 when the latter pivots about a first axis 39 carried by the members 40*a*, 40*b* of a yoke 40, the purpose of which will be specified below. A first cable 41, one end of which is fixed to the central element 42, passes over the pulley 36 of the lever 33, then over a pulley 43 maintained in the central element 42, and winds round a first part of the drum 44 to which it is fixed. A second cable 45, one end of which is fixed through the intermediary of a spring 46 acting as a return system, is wound upon the second part of the drum in the opposite direction to that of the first cable 41. In order to limit the size and nevertheless to have a sufficient length of the second cable 45, the latter is folded over a pulley 47. The drum 44 is mounted on the shaft 3 carrying the driving rollers through the intermediary of a ratchet (or free wheel) system, permitting the rollers to be driven only counter-clockwise. The drum 44 likewise carries a gear 48 adapted to cooperate with the pawl 49, the position and function of which will be indicated below.

The braking device comprises a disk 50 keyed on the axis 3 of the driving rollers, and a friction shoe operated by the central element. In the example illustrated, the shoe consists of a belt 51, fixed at one of its ends to the chassis 1, and the other end of which is fixed through the intermediary of a cable to a part of the central element 42. A return spring 52 is provided between the end of the belt attached to the central element and the chassis 3.

Figure 10:
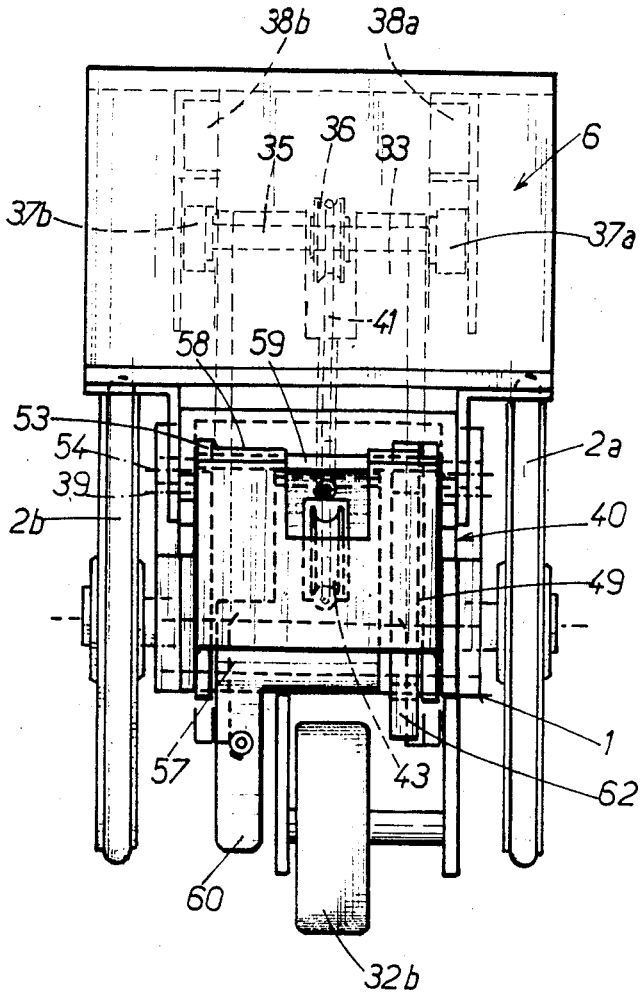
FIG. 10 is a rear elevation of the skate according to ie exemplary embodiment of FIGS. 5–8.

The selection and control device, forming a part of the braking and transmission devices, by which braking or propulsion is permitted, comprises the yoke 40, the central element 42, the pawl 49 and a pivoting stop 53. The members 40*a* and 40*b* of the yoke 40 form angle levers pivoting about a second axis member 54 fixed to the chassis, one end of the angle levers carrying the axis member 39 about which the rear of the pedal 6 pivots. The other end of the angle levers forms stops 55*a*–55*b* which limit the upward rotary movement of the yoke 4 counter to the action of the spring 56 and permits the locking of the rear part of the pedal for the standby and braking positions. The pivoting stop 53 consists of a U-shaped piece, corresponding in length to the distance separating the members 40*a*–40*b* acting as link rods of the yoke 40, and between which it can penetrate at least partly. This pivoting stop 53 pivots about a third axis member 57 fixed to the chassis crossing its ends. The opposite end of the pivoting stop 53 comprises a notch 58 in which the rear part of the transverse arm of the oke 40 is adapted to be placed. The central element 42 nd pawl 49 are arranged within the arms of the pivot- ıg stop 53 and on the same third axis member 57. The entral element 42 is divided into two parts on either ide of the axis 57: an upper part comprising, at its free nd, a hook 59 directed towards the yoke 40, and at its ›wer part an arm 60, to the end of which the braking elt cable 51 is attached. The upper part of the central lement is recessed to form the strap of the pulley 43 FIG. 10) over which the transmission cable 41 passes.

The pawl 49 is approximately U-shaped and pivots on ıe third axis 57 which crosses its transverse arm. The pper lateral arm 61, when the yoke 40 rests upon the otch 58 of the pivoting stop 53, is provided so as to be bove the transverse arm of the yoke 40 but not in ontact, whereas the lower lateral arm 62 is in engage- ıent with the teeth of the gear 48 by the action of a ɜturn spring 63.

The functioning of the skates according to the em- odiment illustrated in FIGS. 5 to 10 is as follows.

Figure 5:
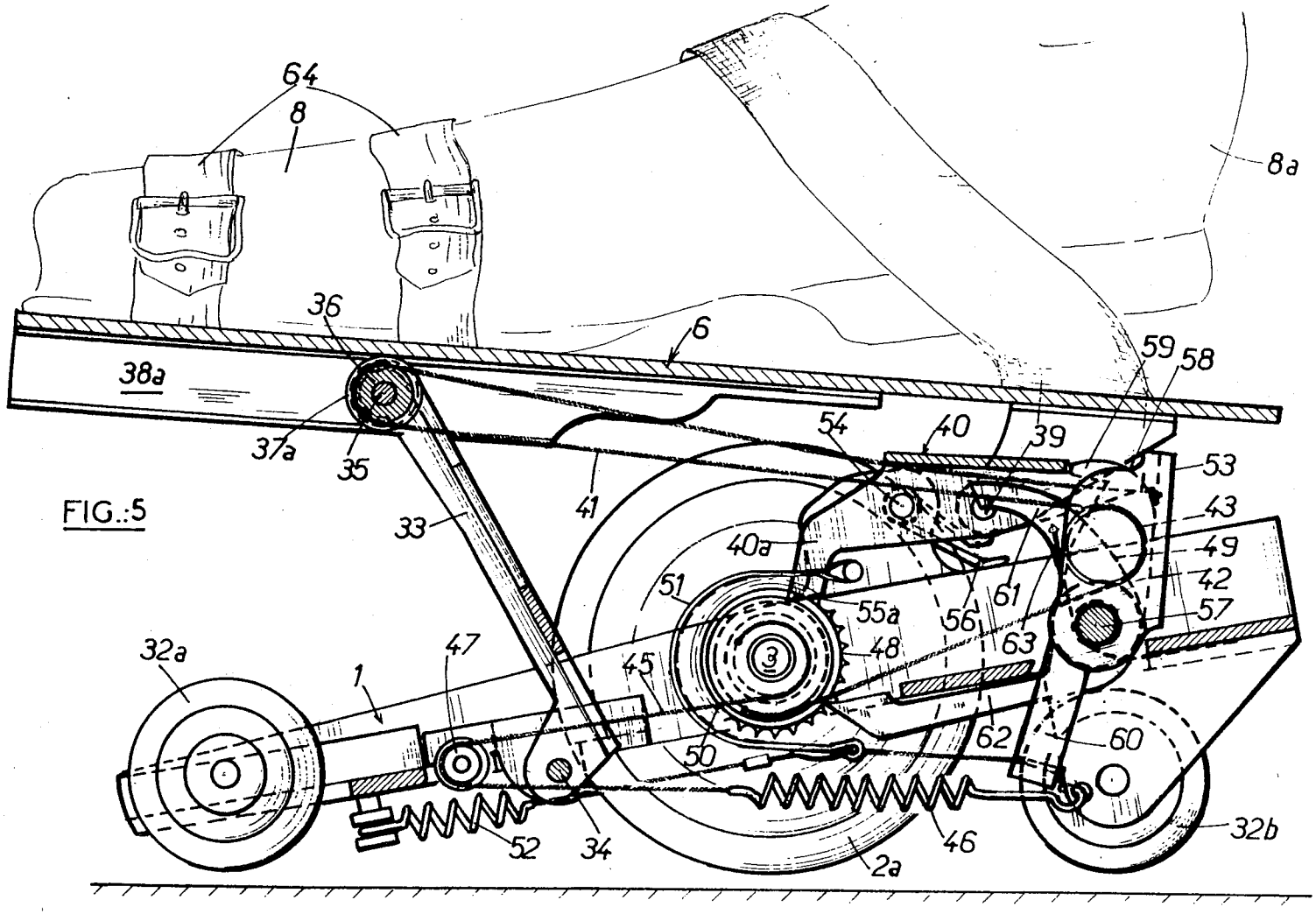
FIG. 5 is a view in longitudinal section of a skate ccording to the invention, the mechanism of which is i the "standby" position.

FIG. 5 illustrates the skate in the standby position. 'his position corresponds to the skate fixed under the ›ot, the latter being raised, the skate therefore support- ıg no weight. The front of the foot 8 (sole and toes) is ıaintained on the pedal 6 by straps 64 (or any other evice) and the rear 8*a* (heel) is connected loosely to the ɜar of the pedal 6 by a device permitting the heel 8*a* to e lifted from the pedal. In this position the elements of ıe selection and control device are arranged as fol- ›ws: the pivoting stop 53 pivots backwards due to its ontact with the central element 42, which is drawn ackwards by the return spring 52. The yoke 40 rests by s stops 55*a*, 55*b* against the chassis 1 by the action of ıe spring 56. The pawl 49 is in engagement with the ɜeth of the gear 48 by the action of its return spring 63.

Starting from this standby position, it is possible to hoose operation (or propulsion) or braking, according › whether, when the skate is placed upon the ground, ıe heel 8*a* or the front 8 of the foot applies a sufficient ressure upon the pedal 6.

Figure 6:
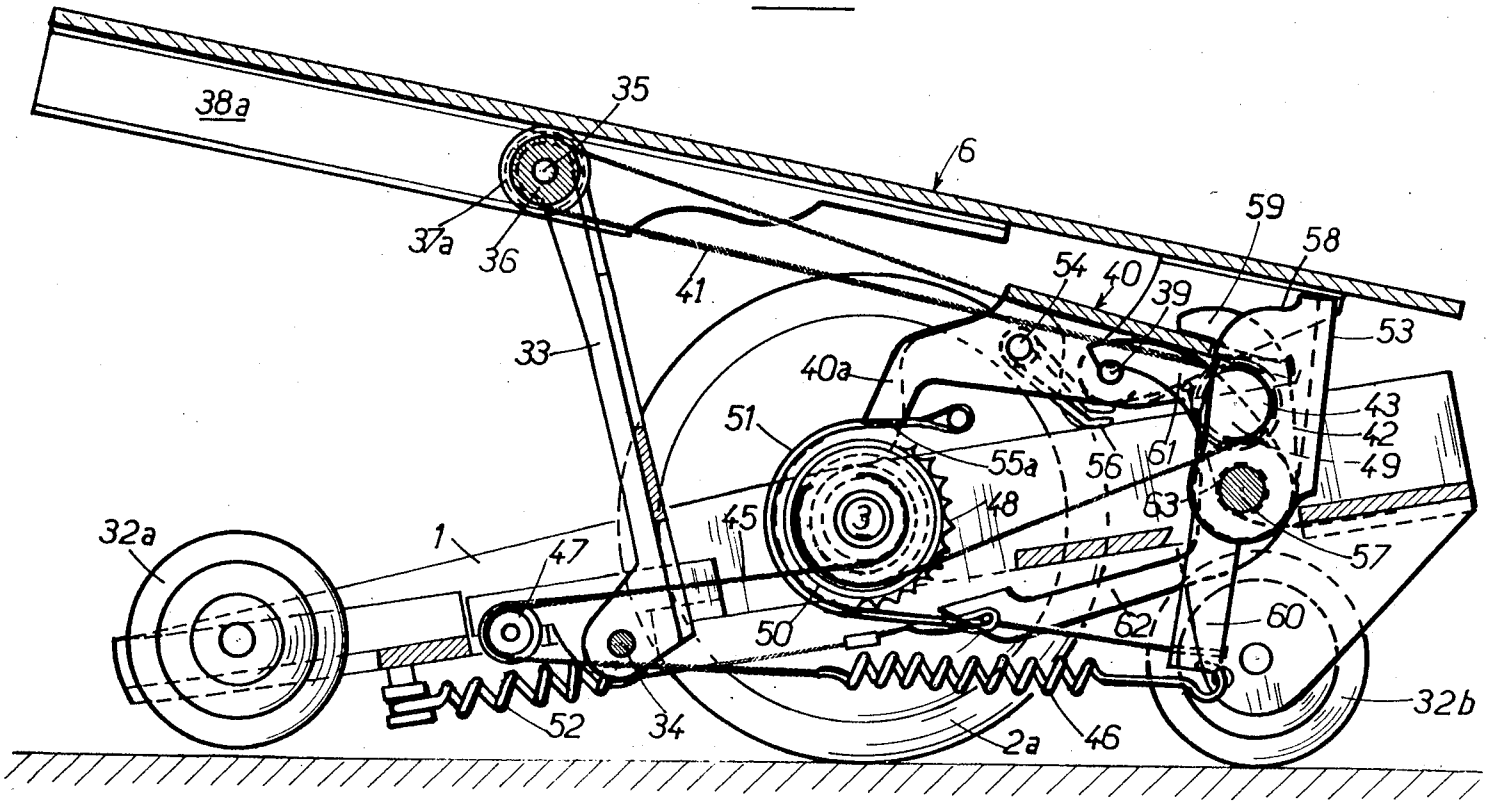
FIG. 6 is a similar view to that of FIG. 5, wherein the iechanism is in the "operative position."
Figure 7:
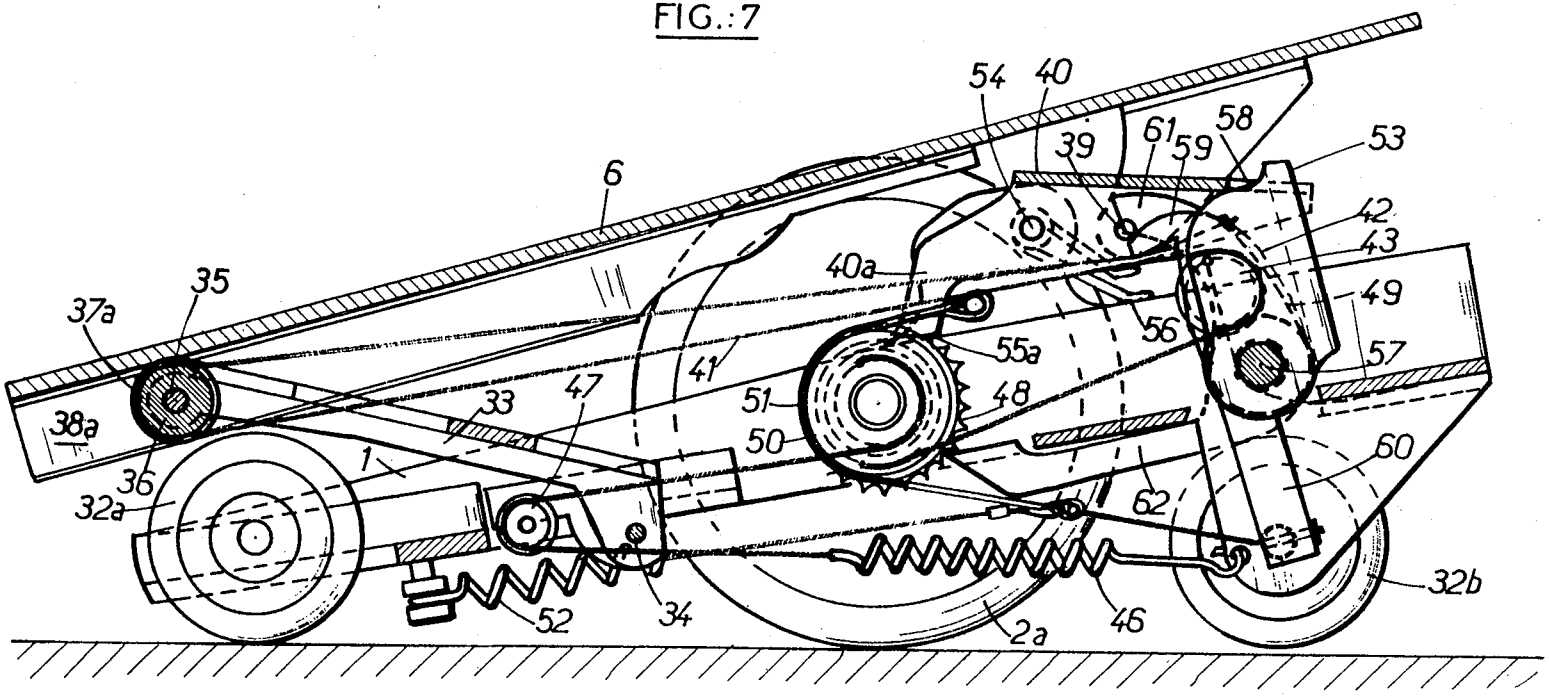
FIG. 7 is a view similar to that of FIG. 5, wherein the iechanism is in the "braking" position.
Figure 8:
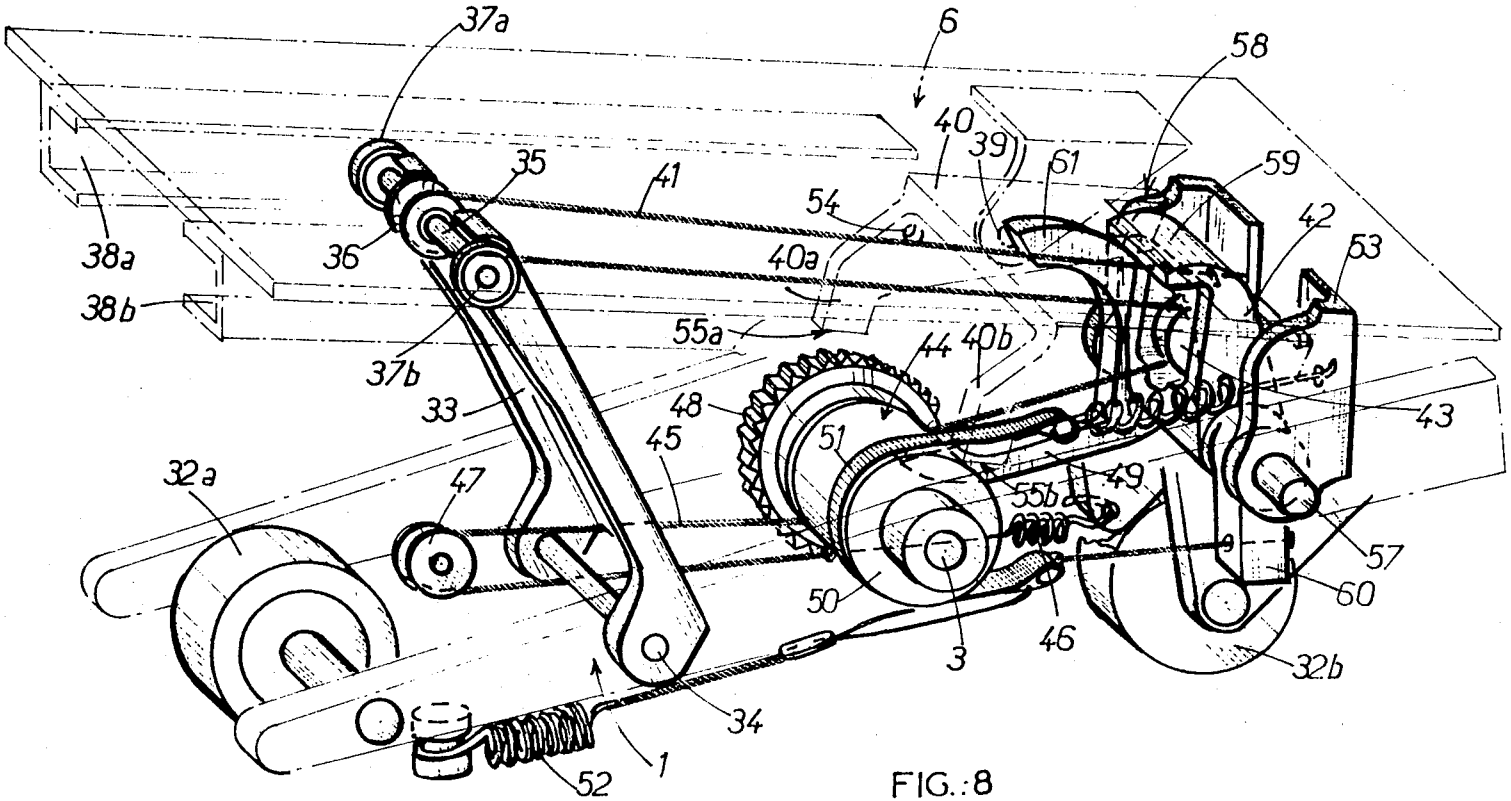
FIG. 8 is a perspective view of the skate according to ie exemplary embodiment of FIGS. 5–7.
Figure 9:
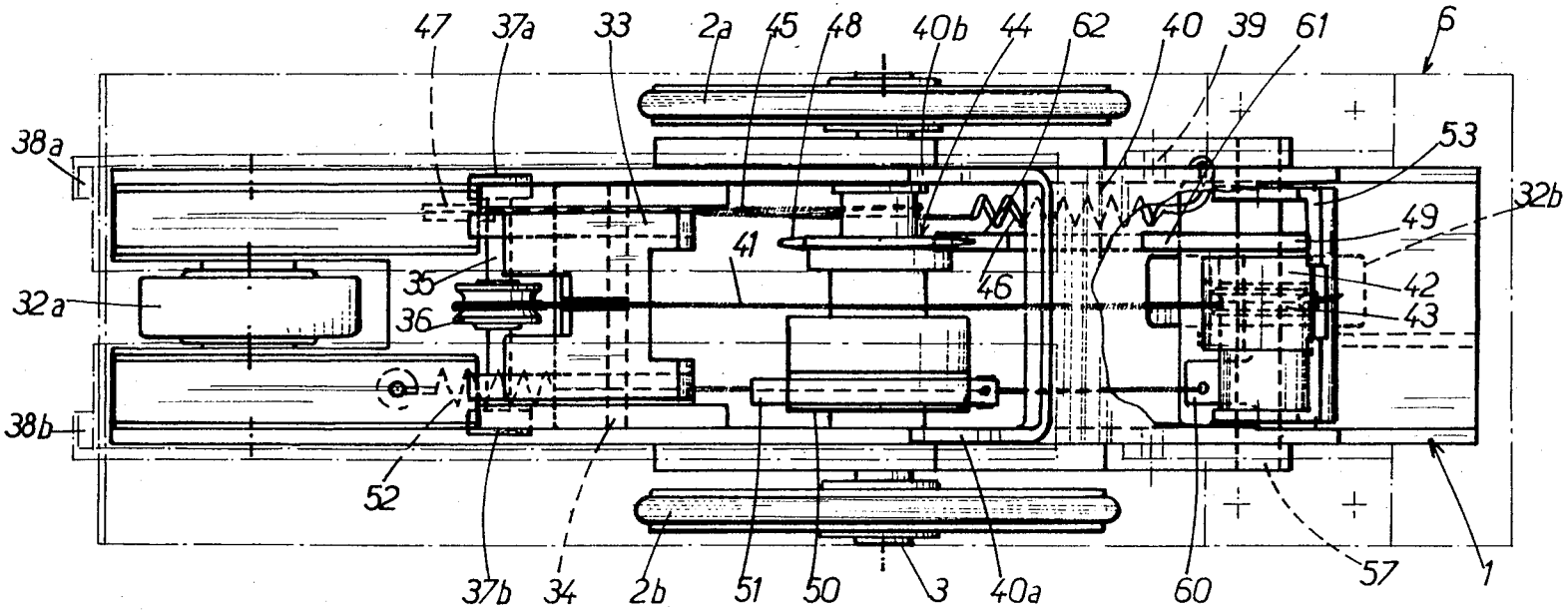
FIG. 9 is a plan view, the pedal being removed of the xemplary embodiment of FIGS. 5–8.

FIGS. 6 to 8 show the elements of the control and ɜlection device in the position which permits propul- on. When the heel 8*a* strikes the ground, which corre- ›onds to placing the skate on the rear roller, the pedal commences to descend backwards, rocking the yoke 0, the transverse arm of which comes in front of the ook 59 and below the latter, bears against the upper ıteral branch 61 of the pawl 49, which separates the ›wer lateral branch 62 from the gear 48. When the foot laces the driving rollers 2*a*, 2*b* upon the ground, the edal 6 pivots forwards and is applied through the inter- ıediary of the wheels 37*a*, 37*b* to the lever 33, which ›cks forwards, pulling on the first cable 41. The cable 1, passing round the pulley 43 of the central element 2, presses the central element against the yoke, apply- ıg the hook 59 against the transverse arm of the yoke. 'he return spring of the yoke can no longer act and the oke is maintained below the hook 59. The counter- lockwise rotation of the central element about the axis 7 is prevented and the braking device cannot operate, nce the belt 51 cannot be entrained by the arm 60 of ıe central element. The cable 41 entrains the drum 44, nwinding counter to the action of the spring 46, to 'hich the second cable 45 is attached which is wound n the second part of the drum 44. Through the inter- ıediary of the ratchet system contained in the drum, ıe rollers are driven in rotation counter-clockwise. 'hen the propulsion requirements necessitate raising the skate above the ground in order to put down the second foot, the control and selection elements reas- sume their standby position permitting the rewinding of the cable 41 round the drum and the return of the spring 46 into its relaxed position.

FIG. 7 shows the position of the control and selection elements in the braking positions. Starting from the standby position, in which the skate is above the ground, when the skate touches the ground on the front roller the pedal 6 acts on the lever 33, rocking it for- ward. The cable 41 passing through the pulley 35 of the lever pivots the central element 42 forward beneath the transverse arm of the yoke, whereas the pivoting stop 53 is advanced by the action of its return spring beneath the yoke to limit its downward rotations. The pawl 49 is placed in contact, by the action of its return spring, with the gear 48 and prevents any movement. Consequently the drum 44 is locked and, being unable to turn, the length of the cable 41 is fixed. Continuation of the ac- tion upon the pedal compels the central element 42 to rock forward, entraining its arm 60 in the opposite di- rection, and consequently the belt 51, which comes to rub against the rim of the disk 50 fixed to the driving rollers 2*a*, 2*b*. Due to the position of the various ele- ments, it is impossible, in spite of the forward rotation of the foot, to operate the transmission device.

According to a simplification, not shown, the pivot- ing stop 53 and the central element 42 may form a single piece, the central element being prolonged backwards by a cylindrical part centered on the axis 57 and of equal radius to the distance of that axis from the lower edge of the transverse arm of the yoke 40 when the members of the latter are in abutment with the chassis.

It should be observed that the selection of the posi- tions is obtained generally from two elements, the yoke and the central element, which are mutually braced the one above or below the other.

These selection and control means may be used for actuating other transmission or braking devices than those described, for example devices employing pneu- matic or electrical means, by action upon valves or contractors.

In all cases, the sequence of selection and control will occur starting from a standby position:

by action upon the rear of the pedal, the operative position is selected with prohibition of braking, then the operation itself by action upon the front of the pedal, by action upon the front of the pedal, the braking position is selected with prohibition of operation, even with a return to bearing on the rear.

Some of the variants described in relation with the first embodiment apply themselves to the second em- bodiment here above described.

The invention is not limited to the embodiments de- scribed, but likewise embraces technical equivalents of the various elements or devices.

I claim:

1. A roller skate which comprises a roller chassis on which a pedal is mounted and which is adapted to sup- port the foot, a selection and control device for mount- ing said pedal pivotably about at least one transverse axis, between a standby position and an operative posi- tion reached each time the skater applies a thrust with his heel to the rear of the pedal in the standby position, at least two rollers upon which the skate will be sup- ported, a braking device which is mounted on the chas- sis so as to be operated each time the skater, with the toe of his foot, applies a thrust to the front of the pedal in the standby position, a transmission device which is mounted on the chassis so as to be operated each time the skater applies a downward thrust with his foot to the pedal transferring it from its operative position into a depressed position, and which is coupled to at least one of the rollers so as to exert a driving action upon it at each operation of the pedal, and elastic spring means to return the pedal from its depressed position into its standby position when the skater raises his foot and said braking device being brought into a braking position selected by said selection and control device each time the skater applies a thrust to the front of the pedal with the toe of his foot wherein the selection and control device employs part of the braking device and the transmission device which parts together are capable of being braced mutually one above or below the other to select, from the standby position, the operative position and thereby apply a thrust upon the rear of the pedal and then apply a propulsion thrust by applying a thrust to the front of the pedal whereby braking is prohibited in this propulsion position, or the braking position by applying a thrust on the front of the pedal whereby propulsion is prohibited in this braking position.

2. A roller skate according to claim 1, which comprises means including at least one wheel and a cam fixed to the chassis, to guide the pedal, and particularly its front part, in its movements between its different positions, and particularly to prevent it, during its depression, from operating the braking device.

3. A roller skate as claimed in claim 1, wherein the selection and control device consists of at least a yoke comprising a first axis on which the rear of the pedal is articulated, said yoke pivoting about a second axis fixed to the chassis;

a central element pivoting about a third axis fixed to the chassis, said axis dividing the element into two parts, a first part carrying a hook directed towards the yoke and with which it is adapted to cooperate, and a second part forming an arm to the end of which a part of the braking device is fixed;

a U-shaped pawl articulated on the third axis, an upper lateral arm of the U being adapted to cooperate with the yoke, the other lower lateral arm with a gear provided on the transmission device, said pawl comprising a return spring placing the arm in contact with the gear when the other arm is not in contact with the yoke.

4. A roller skate as claimed in claim 1, wherein the transmission device comprises a lever articulated by one end to the chassis, the other end carrying wheels cooperating with rolling tracks provided on the front part of the pedal and a pulley over which a cable passes, one end of which is fixed to the central element and the other end of which, passing through the pulley of the central element, is wound onto a part of a drum fixed to the shaft carrying the driving rollers through the intermediary of a ratchet system, said drum comprising a return system permitting the rewinding of the cable.

5. A roller skate as claimed in claim 1, wherein the braking device comprises at least one disk fixed to the shaft carrying the driving rollers, and a friction shoe operated by the central element.

6. A roller skate as claimed in claim 5, wherein the friction shoe consists of a belt, one end of which is fixed to the chassis and the other end of which is fixed to the arm of the central element.

7. A roller skate according to claim 1, wherein one roller comprises a driving roller, of relatively large diameter mounted in the median part of the chassis, the front and rear parts of which each carry at least one idler roller, of equal or different diameter, and that the two planes inferiorly tangent to the driving roller and respectively to one other roller preferably form between them an obtuse angle, the difference from 180 degrees in a range between a few degrees, and a few tens of degrees.

8. A roller skate which comprises a roller chassis on which a pedal is mounted and is adapted to support the foot, a selection and control device for mounting said pedal pivotably between a standby position and an operative position reached each time the skater applies a thrust with his heel to the rear of the pedal in the standby position, a transmission device actuating a median drive roller, a braking device operated each time the skater applies a thrust with the toe to the front of the pedal in the standby position, the transmission device and the braking device each comprising at least one respective element, at least a front and a rear idler roller mounted respectively on the front and the rear of the chassis, wherein at least the two elements from the braking device and the transmission device form the selection and control device which together are capable of being braced mutually one above or below the other to select, from the standby position, the operative position and thereby to apply a thrust upon the rear of the pedal and then to apply a propulsion thrust to the front of the pedal whereby braking is prohibited in this propulsion position, or the braking position by applying a thrust on the front of the pedal and propulsion is prohibited in this braking position.

* * * * *